United States Patent [19]

Thornburg

[11] 4,321,441

[45] Mar. 23, 1982

[54] KEYSWITCH ARRANGEMENT

[75] Inventor: David D. Thornburg, Los Altos, Calif.

[73] Assignee: Xerox Corporation, Stamford, Conn.

[21] Appl. No.: 118,126

[22] Filed: Feb. 4, 1980

[51] Int. Cl.[3] ..... H01H 3/14

[52] U.S. Cl. ..... 200/159 A; 200/5 A; 200/159 B; 200/67 DA

[58] Field of Search ..... 200/159 A, 5 A, 67 DA, 200/159 B, 159 R, 292, 73

[56] References Cited

U.S. PATENT DOCUMENTS

| | | | |
|---|---|---|---|
| 3,383,487 | 5/1968 | Wiener | 200/159 B |
| 4,027,129 | 5/1977 | Sato | 200/159 A |
| 4,029,916 | 6/1977 | Chu | 200/159 B |
| 4,081,898 | 4/1978 | Taylor, Jr. et al. | 200/159 B |
| 4,117,438 | 9/1978 | Kim et al. | 200/159 R |
| 4,207,444 | 6/1980 | Kley | 200/159 B |

FOREIGN PATENT DOCUMENTS

| | | | |
|---|---|---|---|
| 2657546 | 6/1978 | Fed. Rep. of Germany | 200/292 |
| 545991 | 2/1974 | Switzerland | 200/159 A |

*Primary Examiner*—Willis Little

*Attorney, Agent, or Firm*—Serge Abend

[57] ABSTRACT

A keyswitch arrangement including an array of switches formed on a flexible dielectric substrate wherein each switch includes a stationary conductive contact lying in the plane of the substrate and an adjacent movable conductive contactor carried on a flap cut out of the substrate and bent along a hinged line located between the contact and the contactor. The stationary contact and movable contactor are both formed on the same side of the substrate and are normally disposed in the open switch position in confronting relationship with the flap at an acute angle to the plane of the substrate.

9 Claims, 7 Drawing Figures

KEYSWITCH ARRANGEMENT

This invention relates to a keyswitch arrangement fabricated on a flexible circuit board material whose overall size is that of the finished keyboard with which the keyswitch arrangement is associated.

Costs of keyboard entered electronic devices from pocket calculators to personal computers are steadily being reduced. Great strides have been made in lowering the overall system cost by advances in circuit integration wherein the number of electrical devices are being consolidated into a minimum number of semiconductor chips. Also numerous implementations of keyboard design modifications have been introduced in the art with an eye to cost reductions. Yet, due to cost pressures, demand has required that even less expensive structures be built. To this end, manufacturing costs are sought to be reduced by minimizing the number of elements and the number of labor intensive manufacture assembly steps. Similarly, substantial reductions in material requirements are constantly being sought.

In the known prior art numerous implementations of thin membrane matrix keyswitches have been taught. These have reduced manufacturing costs to a heretofore minimal level. For example, in U.S. Pat. Nos. 4,066,851 and 4,096,577 conductive contacts are formed on one portion of a dielectric sheet, conductive contactors are formed on another portion and the two are overlapped with the contacts in alignment. To prevent inadvertent switching the contacts are separated by means of a dielectric spacer having holes in alignment with the contacts, the holes being large enough to allow contact therethrough. Each of these patents discloses, as an alternative embodiment, an integral foldable dielectric sheet wherein a contact zone, a contactor zone and a spacer zone are formed on the same substrate. By folding the dielectric substrate along appropriate fold lines, the keyswitch arrangement is effected. In U.S. Pat. No. 4,081,898 a further material cost reduction over that of the membrane keyswitch arrangement of the above referred to patents has been effected by eliminating (in one embodiment) the spacer sheet. This has been accomplished by forming the movable contactors, of the membrane switching array, upon raised proturberances in the dielectric support which maintain the conductive contacts spaced from one another. When switching contact is desired, electrical connection is made by depressing the appropriate protruberance.

It should be readily apparent that, at best, the keyswitch structures known to the prior art have a total material requirement of twice the keyboard area. In the more prevalent spacer-type keyswitch construction a three-fold dielectric material requirement is called for.

It is the object of the present invention to reduce the keyswitch fabrication cost below that of standard membrane devices by a substantial factor by allowing the dielectric substrate to be no longer than that of the finished keyboard, while retaining the high reliability and cycle life of conventional membrane devices.

The present invention comprises a keyswitch arrangement wherein an array of switches is formed on a flexible dielectric substrate. Each switch includes a stationary conductive contact lying in the plane of the substrate and an adjacent movable conductive contactor carried on a flap cut out of the substrate and bent along a hinge line located between the contact and the contactor. The stationary contact and movable contactor are formed on the same side of the substrate and are normally disposed in the open switch position, in confronting relationship on portions of the substrate lying at an acute angle.

The invention may be carried out in accordance with the following detailed description considered together with reference to the drawings wherein:

FIG. 5 is an alternative embodiment of the keyswitch/keyboard combination of FIG. 4.

Figure 1:
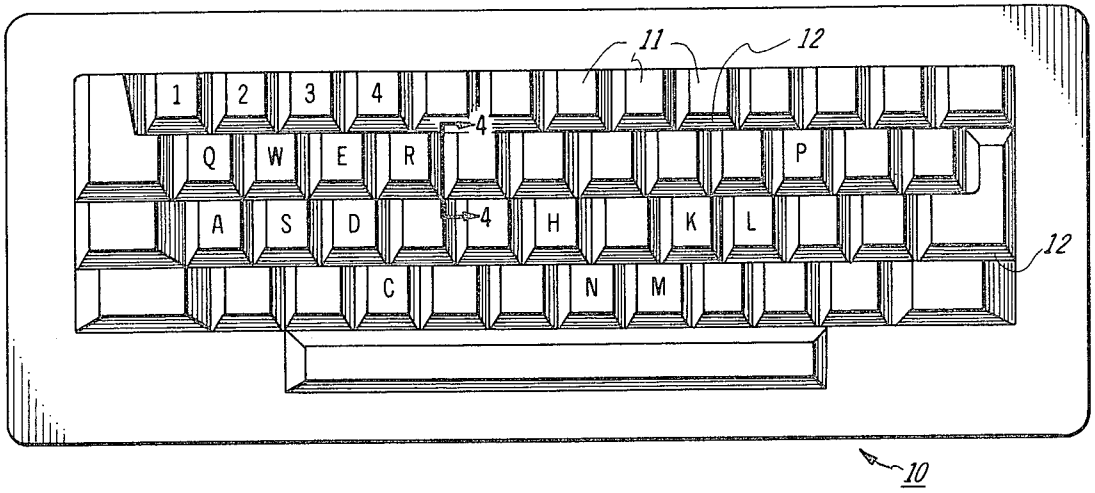
FIG. 1 is a plan view of a standard word processing keyboard with which the present invention may be utilized.

Turning now to the drawings, there is disclosed in FIG. 1 a standard keyboard 10 of the type utilized for known computer terminals. It should be understood, that the present invention may be incorporated in any keyed device, such as a calculator, a game or a control panel. The keyboard comprises a plurality of keys 11 elevated from the surface of a keyboard bezel 12. A switching contact for selecting a desired character or function may be made in a known manner by means of an operator digitally depressing the selected key. Desirably switch closure may be achieved by application of no more force than three (3) ounces and should be of the full strike type, namely, the user should preceive a downward movement of the key. In most membrane type switches there is no "feel" with the result that the user presses harder and tires sooner.

Figure 2A:
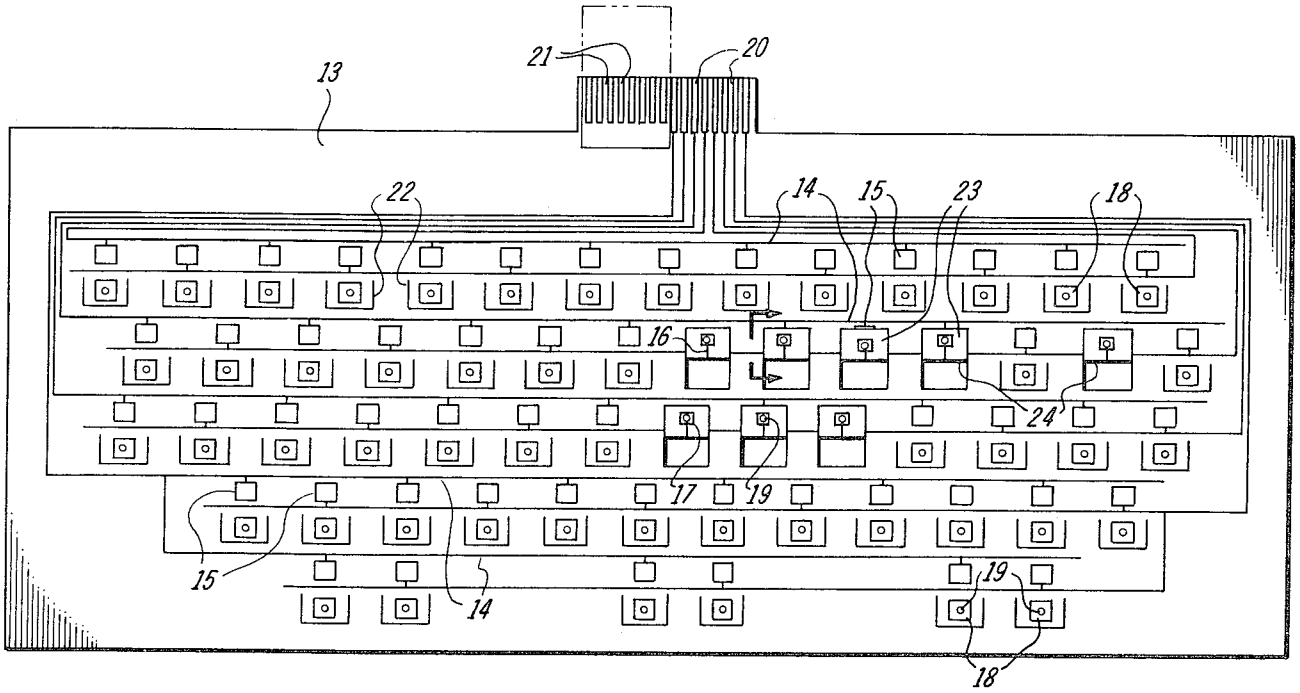
FIG. 2A is a top plan view of the circuit board incorporating the keyswitch arrangement of the present invention.
Figure 2B:
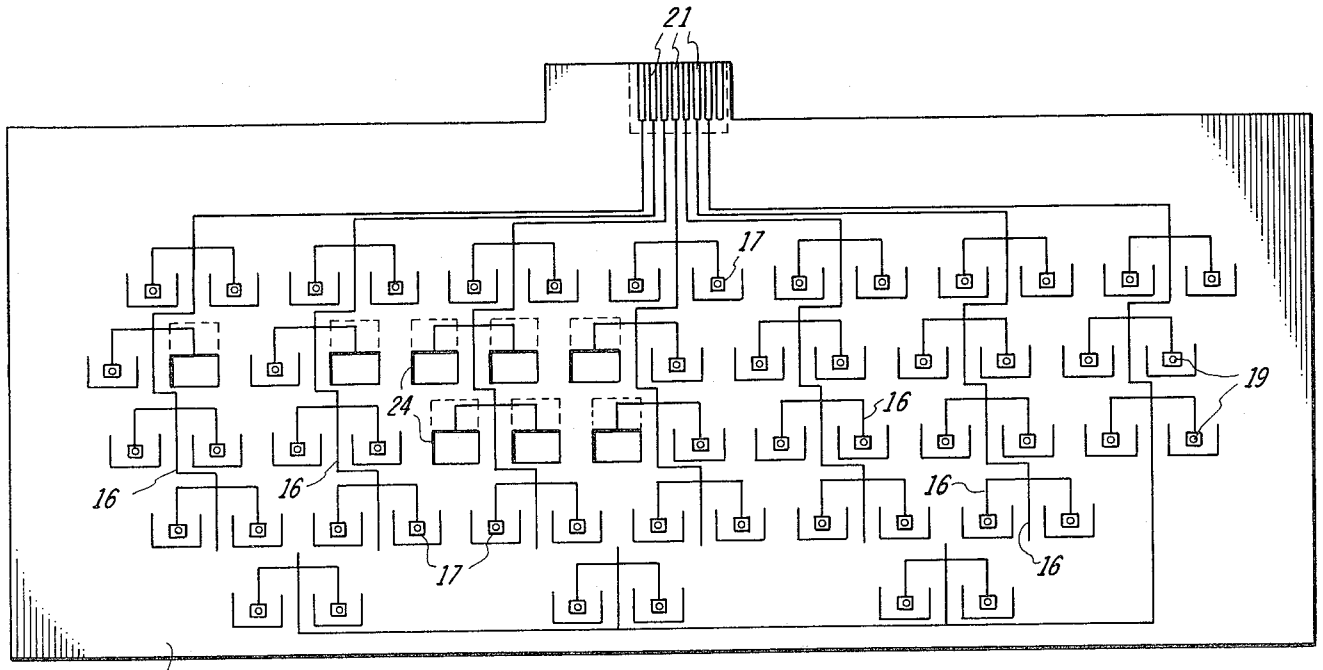
FIG. 2B is a bottom plan view of the circuit board incorporating the keyswitch arrangement of the present invention.

The flexible substrate 13 upon which a keyswitch arrangement is fabricated is shown in FIGS. 2A and 2B. It underlies the keyboard 10. It should be readily apparent that the single substrate sheet carries the entire keyswitch arrangement and is substantially coextensive with the keyboard. This is a major improvement over prior art keyswitch arrangements wherein the substrate material is two or three times the area of the keyboard.

The substrate material 13 used herein may be any one of a number of flexible dielectric circuit board materials such as Mylar (trademark of Dupont), Kapton (trademark of Dupont), or R-Flex (trademark of Rogers Corporation). The latter material comprises a non-woven dacron polyester fiber array embedded a suitable binder material.

A matrix of conductive traces is fabricated on the flexible circuit board substrate by means of known circuit board manufacturing processes. It includes a plurality of generally horizontal conductive traces 14 on its top surface (FIG. 2A) from which conductive contact pads 15 extend laterally, and a plurality of generally vertical conductive traces 16 on its lower surface (FIG. 2B) from which conductive backing pads 17 extend laterally. Each backing pad 17 has associated therewith a conductive contactor pad 18 formed on the upper surface of the flexible circuit board 13 and in alignment therewith. Each of the contactor pads 18 is associated with an adjacent contact pad 15 and is electrically isolated therefrom, the pads being approximately of the same size. A central opening 19 passing through both the contactor pad 18 and its aligned backing pad 17 is plated through during the circuit fabrication process to insure electrical continuity from the vertical conductive traces 16 on the lower surface to the contactor pad 18 on the upper surface. In a smaller keyboard embodiment it could be possible to fabricate all the conductive traces on the same side of the substrate.

The desired conductive pattern may be achieved upon the flexible circuit board substrate 13 by any one of a number of well known methods. For example, the substrate material may initially bear in a thin copper foil on both sides. Then, the foil may be etched into the patterns shown, and the holes 19 punched and plated through. After producing the etched patterns, the contact pads 15 and contactor pads 18, which will form the switch contact areas, may be plated with a non-corrosive wear resistant material such as a noble metal or nickel, for improved performance and extended life. Alternatively, the conductive patterns may be achieved by screen printing conductive inks including copper, silver, gold, nickel or other suitable material in the desired pattern, upon the flexible circuit board substrate.

It should also be noted that the horizontal and vertical conductive traces terminate in conductive stripes 20 located upon an outwardly extending tab portion 21 of the board and comprise plug-in contacts. The terminal stripes 20 of the vertical conductive 16 traces which are located on the lower surface of the circuit board are longer than their counterparts extending from the upper horizontal traces in order that the flexible board may be folded over (as shown in FIG. 2A) to present both sets of terminal stripes on one side (the upper) of the board.

After having produced the conductive patterns on both sides of the substrate board, the board may be trimmed to size and U-shaped incisions 22 are made through the board on three sides of each contactor electrode pad 18. Each U-shaped incision produces a flap 23 which is folded up out of the plane of the board and towards the contact pads 15 so that the contactor pads 18 may be brought into face-to-face confrontation with the contact pads. The uncut side of the flap 23 is creased at 24 to allow the flap to remain in the acute angle position shown in FIG. 3. When the flap is pushed down in use, to cause a contactor pad to touch a contact pad a very slight force is required. Release of that force allows the flap to return to the open, acute angle, as shown.

Figure 3:
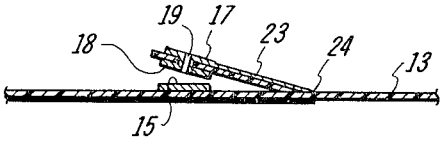
FIG. 3 is a sectional view taken substantially along line 3—3 of FIG. 2A, showing a folded flap keyswitch in greater detail.
Figure 6:
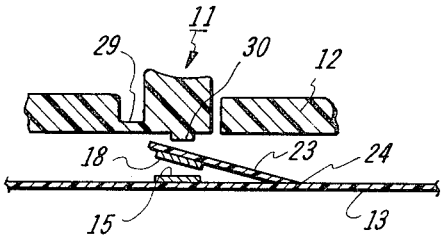
FIG. 6 is a graphic representation of the stress/strain characteristics of a flexible material, which have been utilized in this invention.
Figure 6:
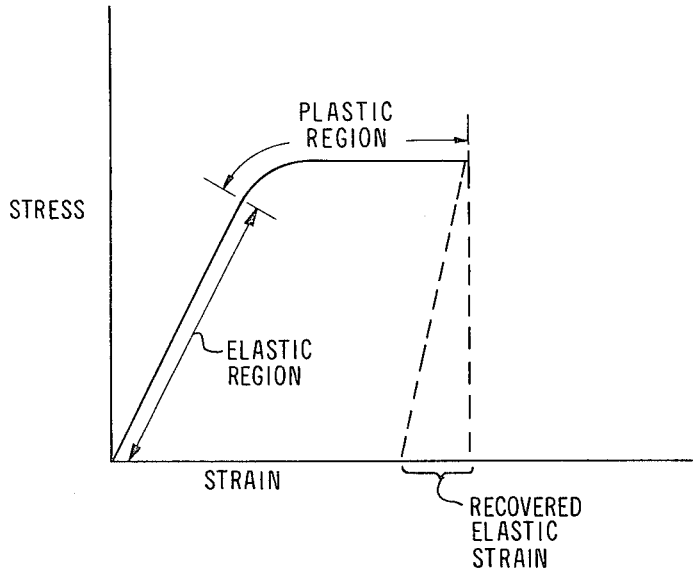

The physical principle relied upon to form the unique switches of this invention is shown graphically in FIG. 6 wherein stress and strain are plotted for a hypothetical material. No values have been identified on the graph since it is merely representative of general characteristics. When a flexible object is stressed, it will initially pass through a region of elastic deformation. In this region, release of the stress force will allow the object to return to its original shape. Application of a stress beyond the elastic region will cause the material to enter the plastic region wherein smaller increments of stress will cause substantial deformation and finally the application of a given stress value will continue to strain the material. Release of the stress force in the plastic region will allow the material to recover some small amount of elastic strain. It is this recovered elastic deformation which is being utilized in this invention. When the flap 23 is initially creased, that portion of the substrate is forced through the elastic region and into the plastic region. The acute angle seen in FIG. 3 is the recovered elastic strain, achieved when the stress is released. In use, the switch operates solely within a new elastic region, e.g. from the acute angle position to the flattened closed switch position. Thus, the intrinsically long life of membrane switches operating in the elastic region, i.e. approximately ten to fifty million flexures before elastic fatigue can be relied upon.

It should be apparent that those portions of the conductive traces 16 which lie upon the creases 24 likewise should not rupture during the creasing step. It has been found that the standard 1.3 mil copper foil thickness will perform satisfactorily.

Figure 4:
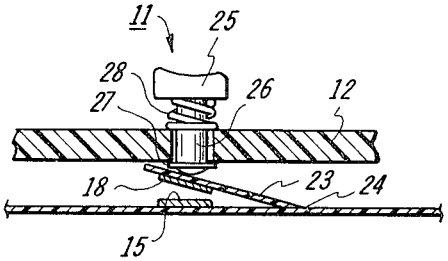
FIG. 4 is a sectional view taken substantially along line 4—4 of FIG. 1, showing one embodiment of the keyswitch incorporated in a keyboard.

Finally, the completed flexible circuit board keyswitch matrix assembly is mounted within a suitable housing beneath a keyboard 10. Since full strike keyboards, wherein the user perceives key travel (about 0.060 inches or greater) prior to making contact, are more satisfying to the user than keyboards with membrane switches wherein there is little perceptible travel (about 5 mil), this invention is shown in FIGS. 4 and 5 in use with full stroke keys. In FIG. 4 there is shown a key II positioned above the unique switch of this invention. The key includes a key top 25 from which a plunger 26 depends and passes through the bezel 12. A retainer 27 secured to the lower end of the plunger 26 prevents removal of the key and a spring 28 maintains the key in its upward, home position. A less expensive alternative key configuration is shown in FIG. 5 wherein the key is integrally formed with the bezel 12 in a single molding operation. A necked-down portion 29 forms the integral hinge for returning the key to its upward, home position. Depending from the key is a protrusion 30 for urging the flap 23 downwardly.

A special advantage is achieved by the cantilever key embodiment of FIG. 6. Since it may be hinged oppositely from the switch as shown, the arc of travel of the cantilever key urges the flap 23 downwardly so that a good contact is guaranteed between contact pad 15 and contactor pad 18. No snagging or buckling of the flexible circuit board flap will take place because movement of the key complements, rather than retards, movement of the switch.

In designing a keyboard for a particular use utilizing the unique key switch set forth herein it is within the purview of a skilled designer to tailor its force/displacement characteristics. One parameter, of course, is the material selected for the flexible circuit board substrate; another is the substrate thickness. Still another is the spring return means utilized for the key, in FIG. 4 the spring 28 and in FIG. 5 the necked-down hinge portion 29.

It should be understood that the present disclosure has been made only by way of example, and that numerous changes in details of construction and the combination and arrangement of parts may be resorted to without departing from the scope and the spirit of the invention as hereinafter claimed.

What is claimed is:

1. A keyswitch arrangement including a substrate on which a plurality of switch elements are formed, said switch arrangement characterized in that said substrate is a flexible dielectric material;

each of said switch elements comprises stationary conductive contact means and movable conductive contactor means, each of said conductive means being positioned adjacent one another on one side of said substrate; and said substrate is provided with incised portions around each of said movable contactor means to form flaps, each carrying one of said contactor means, said substrate further having nonincised hinges integral therewith associated with each flap, so that each of said hinges is located between each of said contact means and its related movable contactor means to allow said switch elements to lie in confronting relationship with one another, each of said flaps having been passed through and beyond the region of elastic deformation and into the region of plastic deformation of said substrate material and disposed at an acute angle to the plane of said substrate when in its operative open switch orientation.

2. The keyswitch arrangement defined in claim 1 wherein first conductive means formed on said substrate connects said stationary conductive contact means to first terminal means on said substrate; and second conductive means formed on said substrate connects said movable conductive contact means to second terminal means on said substrate.

3. The keyswitch arrangement defined in claim 2 wherein said first conductive means is formed on said one side of said substrate; and said second conductive means is formed on the opposite side of said substrate.

4. The keyswitch arrangement defined in either claim 2 or claim 3 wherein said conductive contact means, said conductive contactor means and said first and second conductive means are etched on said substrate.

5. The keyswitch arrangement defined in either claim 2 or claim 3 wherein said conductive contact means, said conductive contactor means and said first and second conductive means are printed on said substrate.

6. The keyswitch arrangement defined in claim 3 wherein said movable conductive contactor means is connected to said second conductive means via plated through openings passing through said substrate.

7. The keyswitch arrangement defined in claim 1 in cooperation with a keyboard on which are supported a plurality of keys, said keys being of the plunger type wherein plungers depend from said keys for closing said keyswitches when said keys are depressed.

8. The keyswitch arrangement defined in claim 1 in cooperation with a keyboard on which are supported a plurality of cantilever keys.

9. The keyswitch and keyboard arrangement defined in claim 8 wherein the supported portions of said cantilever keys comprise hinges which lie in opposed relation to said flap hinges.

* * * * *